US005318261A

United States Patent [19]

Petershofer et al.

[11] Patent Number: 5,318,261

[45] Date of Patent: Jun. 7, 1994

[54] DEVICE FOR THE CONCEALED HANGING OF PANELS FROM LOAD-BEARING STRUCTURES

[75] Inventors: Georg Petershofer, Wiener Neudorf; Alexander Simon; Horst Felzmann, both of Wien, all of Austria

[73] Assignee: ISOVOLTA Osterreichische Isolierstoffwerke Aktiengesellschaft, Austria

[21] Appl. No.: 982,760

[22] PCT Filed: Jul. 10, 1992

[86] PCT No.: PCT/AT92/00096

§ 371 Date: Mar. 10, 1993

§ 102(e) Date: Mar. 10, 1993

[87] PCT Pub. No.: WO93/01418

PCT Pub. Date: Jan. 21, 1993

[30] Foreign Application Priority Data

Jul. 11, 1991 [AT] Austria ..... 1397

[51] Int. Cl.[5] ..... A47B 96/06

[52] U.S. Cl. ..... 248/205.1; 52/713

[58] Field of Search ..... 248/222.1, 205, 327, 248/214, 295.1, 231.4, 231.6; 52/508, 511, 513, 713, 714

[56] References Cited

U.S. PATENT DOCUMENTS

| | | | |
|---|---|---|---|
| 1,335,881 | 4/1920 | Dottl | 248/222.1 |
| 4,010,924 | 3/1977 | Parsons et al. | 248/225.3 |
| 4,327,888 | 5/1982 | Scheneman | 248/221 |

FOREIGN PATENT DOCUMENTS

| | | |
|---|---|---|
| 1684060 | 5/1971 | Fed. Rep. of Germany . |
| 2460880 | 6/1976 | Fed. Rep. of Germany . |
| 3542434 | 3/1991 | Fed. Rep. of Germany . |
| 2097543 | 2/1972 | France . |
| WO89/02960 | 4/1989 | PCT Int'l Appl. . |

*Primary Examiner*—Ramon O. Ramirez
*Attorney, Agent, or Firm*—Bacon & Thomas

[57] ABSTRACT

A device for concealed, i.e. masked suspension of panels from loadbearing structures and consisting of two bent metal parts fastening into the panel is described, a U-shaped metal part 1, 1' being adjustably linked by an adjustment screw 3, 3' to a metal part 2, 2' so as to be mutually displaceable, the legs 1*a*, 1*a'*; 2*a*, 2*a'* of the metal parts 1, 1'; 2, 2' resting against each other and the two metal parts 1, 1'; 2, 2' resting flat by their other legs 1*b*, 1*b'*; 2*b*, 2*b'* against the panel 5, 5' and by their angled end zones 6, 6'; 7, 7' entering channels 8, 8'; 9, 9' milled into the panel and thereby ensuring positive locking to the panel 5, 5'.

12 Claims, 4 Drawing Sheets

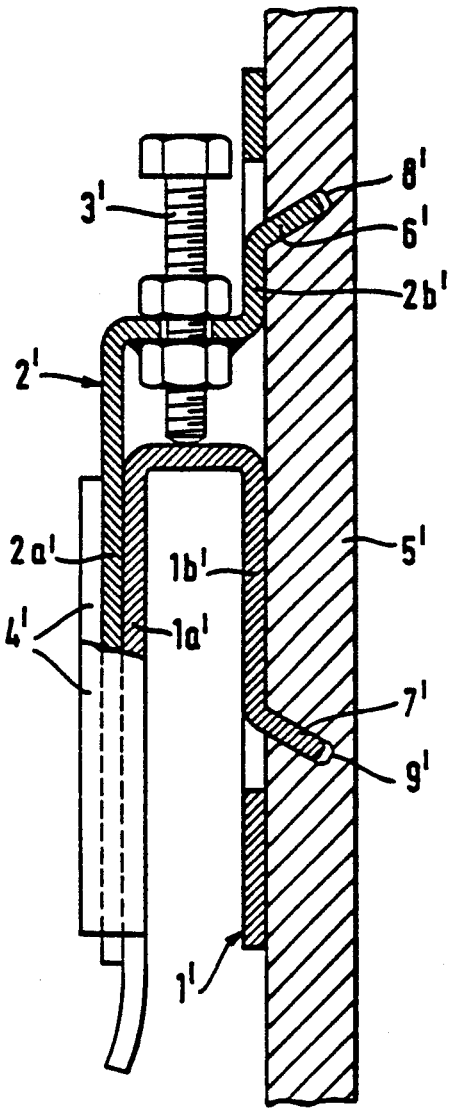
Fig. 6
Fig. 4
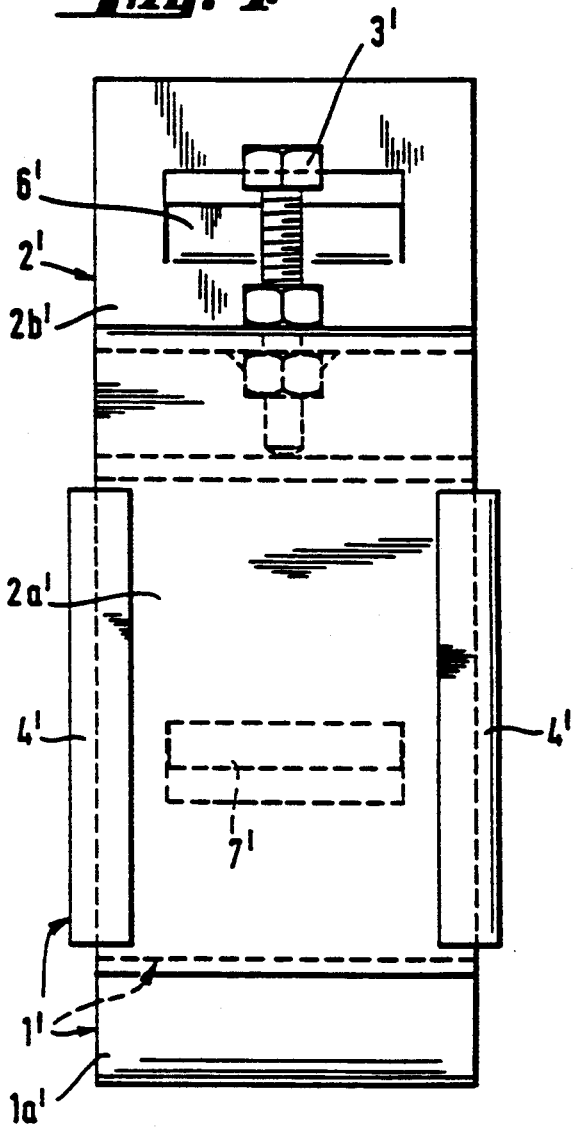
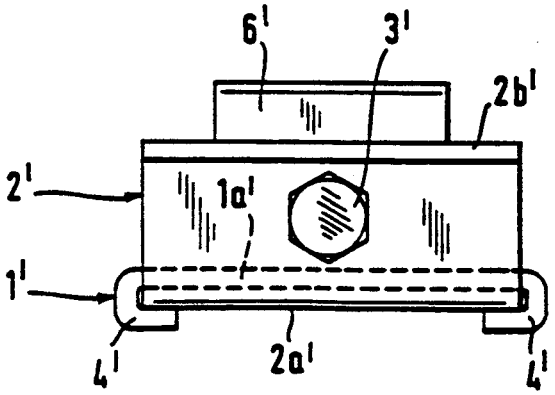
Fig. 5

Fig. 7
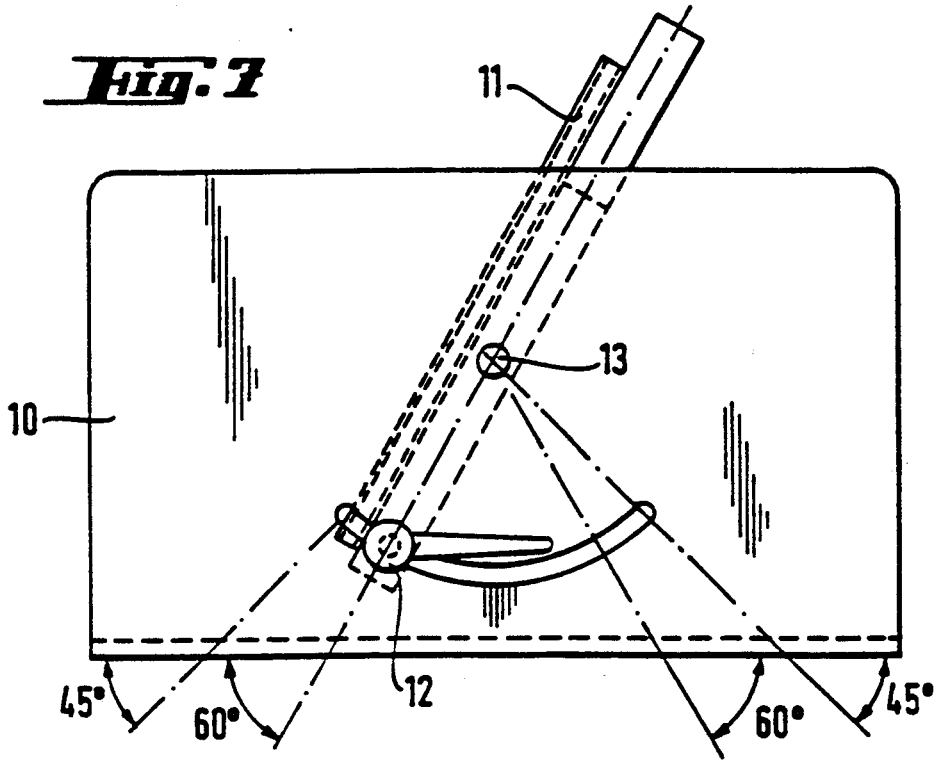
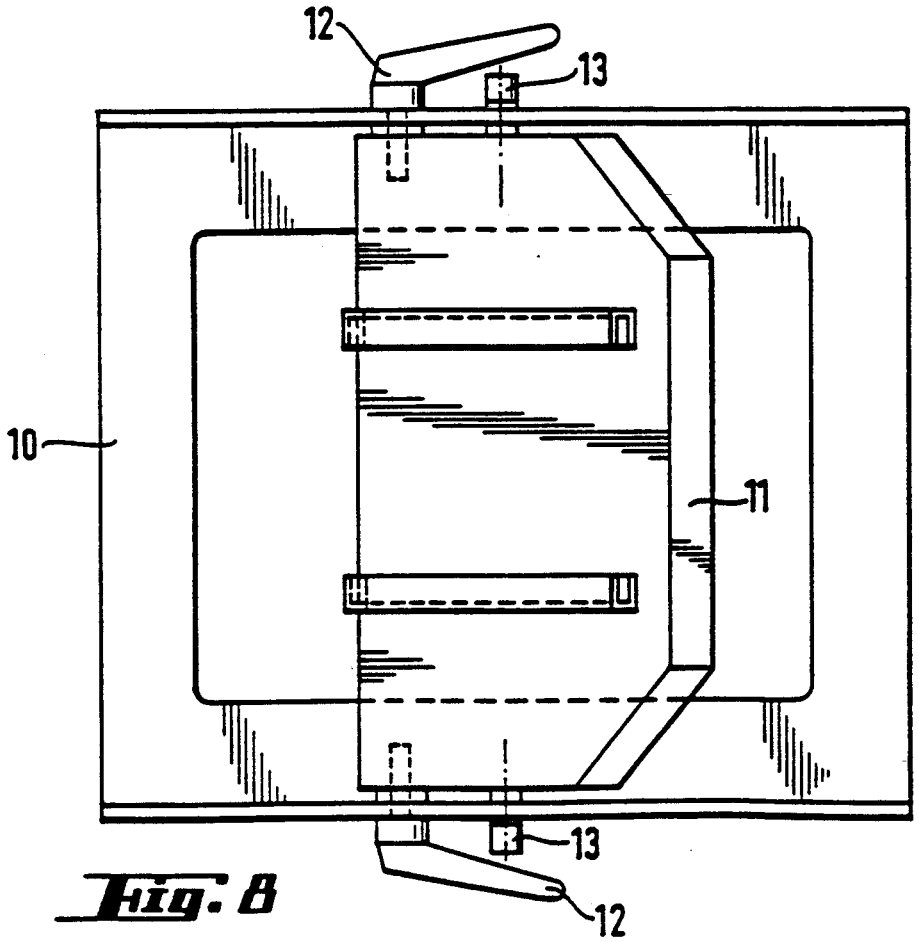
Fig. 8

Fig. 9
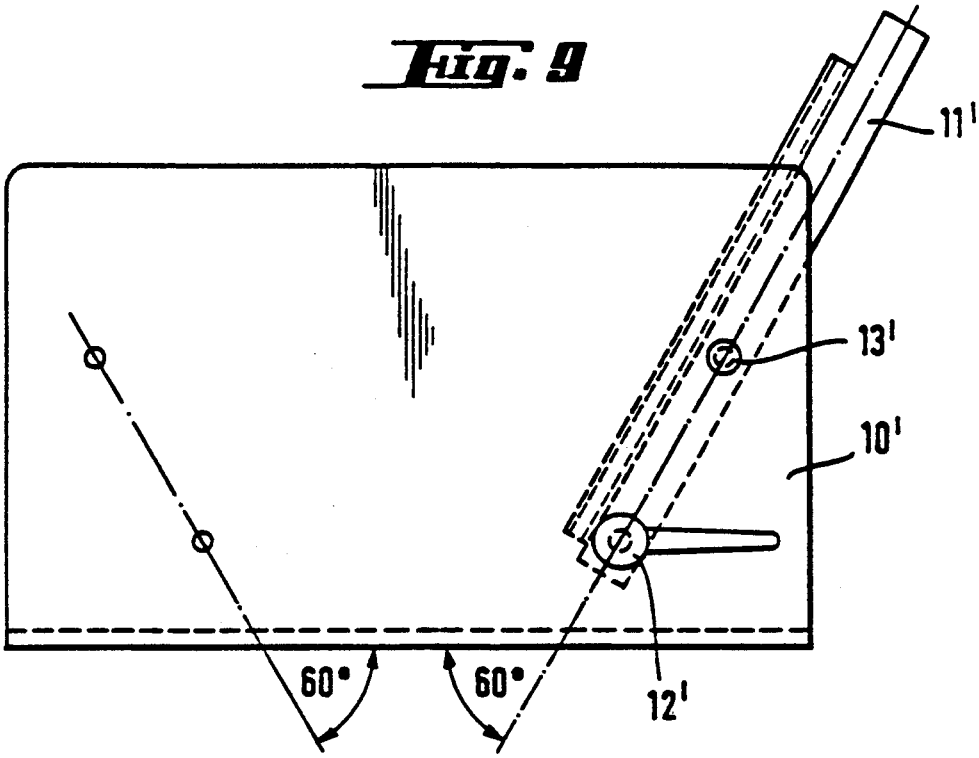
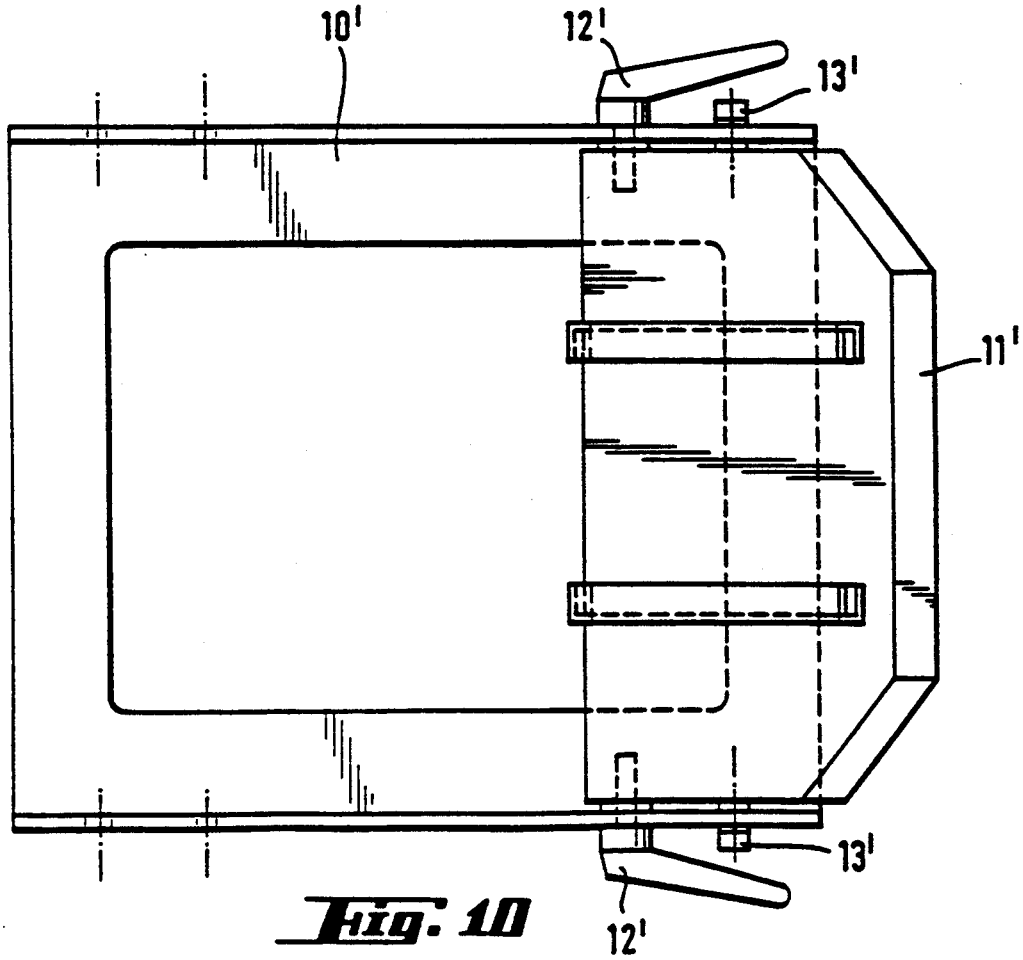
Fig. 10

DEVICE FOR THE CONCEALED HANGING OF PANELS FROM LOAD-BEARING STRUCTURES

TECHNICAL FIELD

The invention concerns a device for hanging panels from load-beating structures in concealed manner and consisting of two bent metal parts affixed to the panels, and further it concerns a method for locking in positive manner this device to the panel.

STATE OF THE ART

As regards the visible fastening of panels to load-beating structures, it is known to enclose said panels in U-channels themselves affixed to the load-bearing structure. These U-channels incur the drawback they will not accommodate the thickness tolerances entailed by manufacturing. "Undersized" panels (i.e. too thin) relative to the nominal thickness shall only sit loosely inside the channel, whereas "thicker" panels can be inserted only by bending the channel while ruining the panel surface. Moreover the panels only can be gripped at their edges, and frequently this is inadequate when affixing large-area panels. In addition, half the U-channel always is visible from the outside.

In order to achieve masked affixing of panels to load-beating structures, U channels may be affixed to said structures by entering channels milled into the panel edge. The channels are parallel to the plane of the panel and are half the panel-thickness deep. As a result the panel thickness available for mechanical strength is reduced to less than half. Accordingly this method only allows mounting in masked manner panels no more than a certain size to load-beating structures.

DESCRIPTION OF THE INVENTION

The object of the invention is to create a device for affixing panels of various thicknesses and various formats in masked manner.

The problem basic to the invention is solved in that a U-shaped bent metal part 1, 1' is juxtaposed with an angle metal part 2, 2' so as to be mutually displaceable in the direction of the legs, both metal parts evincing obliquely bent end zones at one end which by entering two channels milled into the panel thereby positively lock into it. Advantageously lateral guide sections are present at one of the level leg zones of one of the two metal parts to receive the other metal part in displaceable manner. Furthermore, the two metal parts can be advantageously adjusted relative to each other by means of an adjustment screw.

In one advantageous embodiment of the device of the invention, the end zones of the bent metal parts subtend an angle of 45° to 80° with the panel plane and are mutually converging.

In another advantageous embodiment mode of the invention, the end zones of the bent metal parts are mutually diverging.

The invention moreover relates to a method to positively lock the device of the invention onto the panel. This method is characterized in that the channels are machined into the panel surface at an angle matching one of the angled end zones of the bent metal parts and by inserting and affixing the oblique end zones. The milled depth amounts to 50 to 95%, preferably 75 to 85% of the panel thickness and the sidewalls of the channels advantageously are milled to be arcuate. Also, a chamfered milling base is introduced when making the channels.

In a last and advantageous embodiment mode of the invention, milling is carried out by a manual milling machine displaceable in a milling guide and adjustable in a milling jig about a shaft at various angular positions relative to the panel surface.

DESCRIPTION OF THE FIGURES

The invention is elucidated below in relation to FIGS. 1 through 10 and in two advantageous embodiment modes for affixing the devices of the invention in positive manner.

Figure 3:
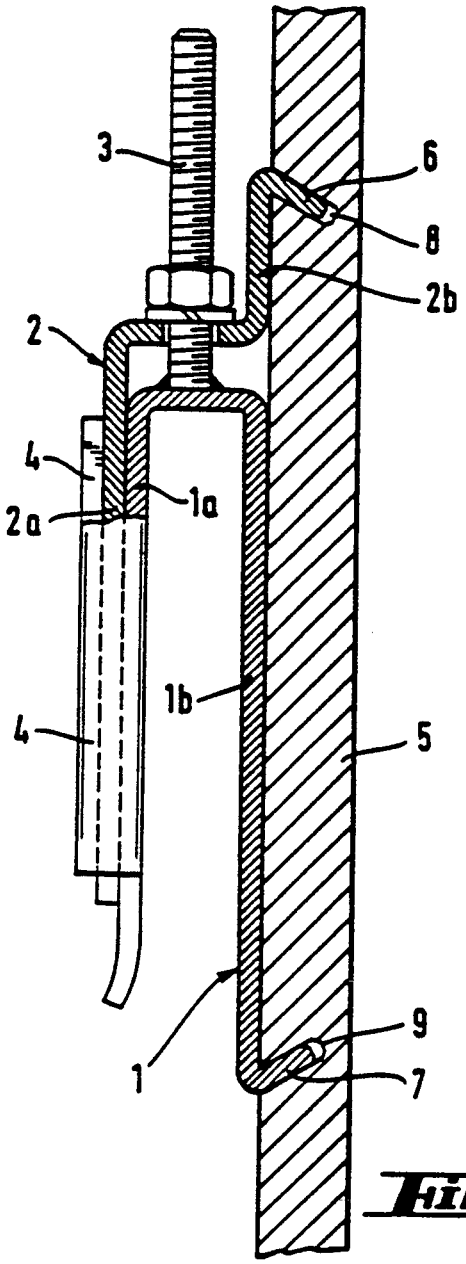
FIG. 3 is a side view of the device of FIG. 1, with the U-shaped metal part 1 and the right-angled metal part 2, which rest against each other by their legs **1*a*, 2*a* and which are mutually adjustable by means of an adjustment screw 3 or nut, being kept together by the guide channel 4. The legs 2*b* and 1*b* of the metal parts 1, 2 rest against the panel 5**.

The metal parts 1, 2 comprise end zones 6, 7 which in this embodiment mode are bent to be converging and which are received in the channels 8, 9 milled into the panel 5.

FIG. 4 is an elevation of another embodiment mode of the invention showing the zone **2*b* resting flat against the panel 5', the angled end zone 6', the adjustment screw 3', a guide channel 4' and the U-shaped metal part 1'. FIG. 6 shows the second angled end zone 7' which is bent approximately centrally out of the leg 1*b'* resting against the panel 5'**.

FIG. 5 is the top view of the device of the invention shown.in FIG. 4.

FIG. 6 is a side view of the embodiment mode of the invention shown in FIG. 4, a U-shaped bent metal part 1' and a right-angled metal part 2' resting against each other by their legs **1*a'* and 2*a'* and being mutually adjustable by an adjustment screw 3', the leg 2*a'* being laterally held in place by the guide channels 4' of the metal part 2'. In this particular embodiment, the end zones 6', 7' are angled to be merely divergent and are inserted into the channels 8', 9' milled into the panel 5'**.

FIG. 7 shows a milling jig 10 with a milling guide 11 receiving a manual miller which can be adjusted by rotation about the shaft 13 at angles of 45° and 60° relative to the panel surface using the toggle 12.

FIG. 8 is a top view of the jig shown in FIG. 7.

FIG. 9 shows a milling jig 10' with a milling guide 11' mounted by T-screws 12' and bolts 13' at a fixed angle of 60° to the panel surface. The milling jig 10' also comprises bore holes to set the milling guide 11' in the opposite direction.

FIG. 10 is the top view of the system shown in FIG. 9.

Illustratively the device of the invention may be made of galvanized steel, stainless steel or aluminum alloys. The thickness of the material is between 1.5 and 3.5 mm.

Figure 1:
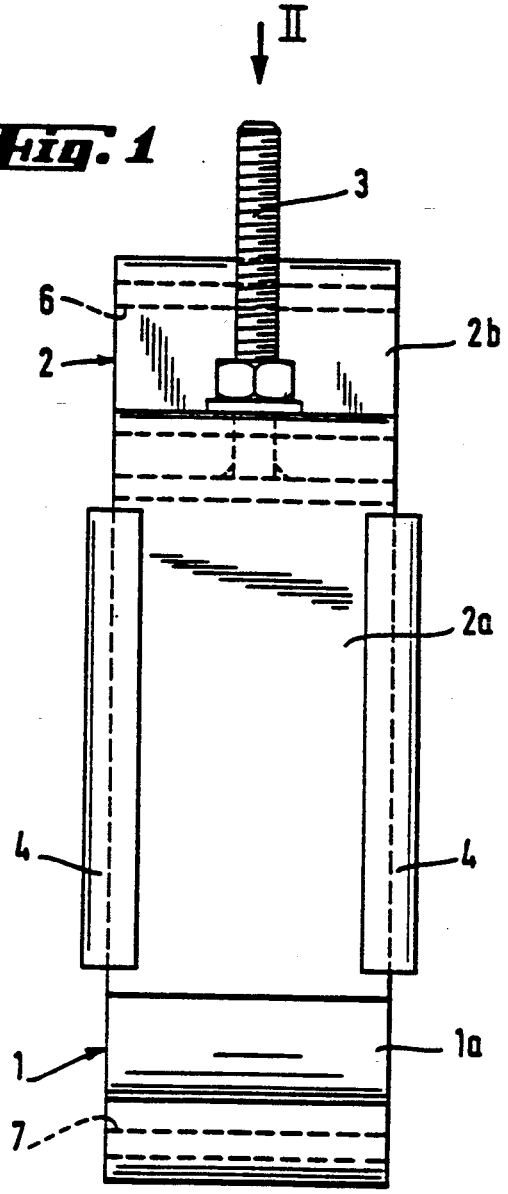
FIG. 1 shows the elevation of the device of the invention, the part **2*b* of the right-angled metal part 2 resting against the panel, the angled end zones 6, 7, a guide channel 4, the U-channel metal part 1 and the adjustment screw 3** also being shown.
Figure 2:
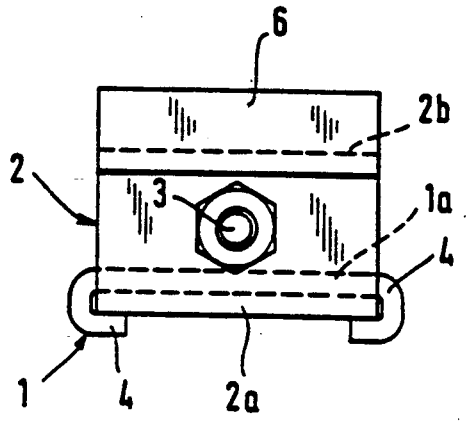
FIG. 2 shows a top view of the device of the invention along arrow II of FIG. 1.

By means of a jig shown in FIGS. 7 and 8, channels 8 and 9 are milled into the panel 5. The milling guide of the milling jig 10 is preadjusted by the toggle 12 at an angle for instance of 45° or 60° to the panel surface, and said milling jig is set on the panel and a manual milling machine, omitted from the drawing, is displaced along the milling guide 11 toward the panel 5 whereby the circular miller finally mills a channel with an arcuate channel wall into the panel 5. Illustratively the depth of milling may be 80% of the depth of the panel. Preferably the milling bottom shall be chamfered. Thereupon a device such as shown in FIGS. 1 through 3 is inserted into these channels 8, 9, then tensioned, and prestressed by the adjustment screw 3 and affixed in position, the prestressing magnitude being determined by the tightening force of the adjustment nut 3 and as result may control the connection between the device and the panel 5.

To make channels that are mutually diverging, the apparatus described in relation to FIGS. 9 and 10 shall advantageously be used. This apparatus comprises a milling jig 10' in which the milling guide 11' is at a fixed angle of 60° to the panel surface. Milling the channels using a manual milling machine displaceable in the milling guide 11' takes place similarly to the apparatus described in relation to FIGS. 7 and 8. The angled end zones 6', 7' of the device of the invention shown in FIGS. 4 through 6 are then inserted into these mutually diverging channels and the said device is then prestressed and affixed in position, the prestressing being produced by tightening the adjustment screw. To prevent any bulging or detachment of the legs 1*b'*, 2*b'* resting against the panel 5' between the angled end zones 6', 7' during prestressing, the legs 1*b'*, 2*b'*are extended beyond the ends.

The devices of the invention shown in FIGS. 1 through 3 and 4 through 6 are suitable for the masked suspension of panels of the most diverse formats, that is, also for large-scale panels, further panels of the most varied thicknesses, from load-bearing structures. The visible panel surfaces remain undamaged during the advantageous procedure for positively locking the device of the invention to the panel on account of the presence of channels.

We claim:

1. A device for the concealed suspension of panels from load bearing structures, comprising two metal parts for affixing to a panel, the first metal part comprising a U-shaped part including a first leg portion and the second metal part comprising a right-angled part including a second leg portion resting against said first leg portion, said leg portions being mutually displaceable with respect to one another, both first and second metal parts including angled end zones at one of their ends for entering channels milled into a panel thereby locking said device onto the panel.

2. Device defined in claim 1, wherein lateral guide channels are present in the leg portion of one of the two metal parts, the leg portion of the other metal part being mounted in displaceable manner inside said guide channel.

3. Device defined in claim 1, wherein the two metal parts are mutually adjustable by means of an adjustment screw.

4. Device defined in claim 1, wherein the end zones of the bent metal parts subtend an angle between 45° and 80° with the panel.

5. Device defined in claim 1, wherein the end zones of the bent metal parts are mutually converging.

6. Device defined in claim 1, wherein the end zones of the bent metal parts are mutually diverging.

7. A method for positively affixing a device defined in claim 1, wherein channels are milled into the panel surface at an angle matching the angled endzones of the bent metal parts and in that the angled end zones are inserted, prestressed and affixed.

8. Method defined in claim 7, wherein the depth of milling is 50 to 95%, of the panel thickness.

9. Method defined in claim 7, wherein when milling the channels, the channel sidewalls are made arcuate.

10. Method defined in claim 7, wherein the milling bottom is chamfered.

11. Method defined in claim 7, wherein milling is carried out using a manual milling machine displaceable within a milling guide, said machine being rotatably adjustable in a milling jig about a shaft into different angular positions relative to the panel surface.

12. Method defined in claim 7, wherein the depth of milling is 75 to 85% of the panel thickness.

* * * * *